US008056168B2

(12) United States Patent
Asaka et al.

(10) Patent No.: US 8,056,168 B2
(45) Date of Patent: Nov. 15, 2011

(54) BAMBOO CHARCOAL PILLOW

(75) Inventors: Kimiko Asaka, Ibaraki (JP); Noriko Tako, Ibaraki (JP); Kazue Matsumoto, Toyama (JP); Mai Asaka Scaduto, Santa Monica, CA (US); Sayuri Nakamura, Kanazawa (JP)

(73) Assignee: Taira Clean Industry, Osaka (JP)

( * ) Notice: Subject to any disclaimer, the term of this patent is extended or adjusted under 35 U.S.C. 154(b) by 407 days.

(21) Appl. No.: 12/318,399

(22) Filed: Dec. 29, 2008

(65) Prior Publication Data

US 2009/0205135 A1 Aug. 20, 2009

(30) Foreign Application Priority Data

Dec. 28, 2007 (JP) ..... 2007-339743

(51) Int. Cl.
*A47C 20/00* (2006.01)

(52) U.S. Cl. ..... 5/645; 5/636; 5/641

(58) Field of Classification Search ..... 5/636, 638, 5/639, 640, 641, 643, 644, 645, 694, 724, 5/725, 727, 728, 652.1, 655.9, 657, 722, 5/723

See application file for complete search history.

(56) References Cited

U.S. PATENT DOCUMENTS

| | | | | |
|---|---|---|---|---|
| 3,243,828 | A * | 4/1966 | McCarty | 5/636 |
| 4,916,765 | A * | 4/1990 | Castronovo, Jr. | 5/640 |
| 5,682,633 | A * | 11/1997 | Davis | 5/636 |
| 5,781,947 | A * | 7/1998 | Sramek | 5/636 |
| 5,918,333 | A * | 7/1999 | Takashima | 5/641 |
| 6,230,347 | B1 * | 5/2001 | Alexander | 5/636 |
| 2007/0065625 | A1 * | 3/2007 | Lai | 428/71 |

* cited by examiner

*Primary Examiner* — Robert G Santos
*Assistant Examiner* — Nicholas Polito
(74) *Attorney, Agent, or Firm* — Manabu Kanesaka

(57) ABSTRACT

A pillow 1 stores a main part 2 and an elastic part 3 laminated by the main part 2 in a cover part 4. The main part 2 includes a core material 21 arranged along a longitudinal direction, and a storage object 23 in which charcoal 22 is stored at both sides, and is covered by a cover material 25. A concave portion 27 is formed in a position corresponding to the core material 21. The elastic material 3 has elastic materials 31, 32 and 33 having hardness which becomes larger as they come closer to the main part 2. A convex part 27 is formed in the surface, and a convex part 34 of the elastic part 3 is fitted to the concave portion 27, and a portion corresponding to the convex part 34 is formed thicker than a portion which does not support the convex part 34.

13 Claims, 7 Drawing Sheets

BAMBOO CHARCOAL PILLOW

BACKGROUND OF THE INVENTION AND RELATED ART STATEMENT

The invention relates to a pillow where charcoal is used.

In recent years, the pillow containing bamboo charcoal with various structures where bamboo charcoal is stored inside the pillow has been developed in view of the effects of the deodorization, moisture absorption, and antibacterial action of bamboo charcoal. With this pillow containing bamboo charcoal, discomfort by the sweat and the smell which come out of a user's head and etc. during the sleep can be reduced by the moisture absorption and deodorizing action of bamboo charcoal which is stored inside the pillow, and it is also excellent in the health by the antibacterial action of bamboo charcoal and cool feeling can be given to a user. There is a pillow containing bamboo charcoal, which comprises only a main part in which bamboo charcoal is stored inside. With such a pillow structure containing bamboo charcoal, the effect of bamboo charcoal has been demonstrated, but there is a problem that a feeling is hard when a user touches the surface of a pillow, and it is not comfortable.

In order to solve the problem mentioned above, the pillow containing bamboo charcoal with various structures has been developed. FIG. 7 is a diagram showing the pillow containing bamboo charcoal as an example in the prior art. As shown in FIG. 7, pillow 101 containing bamboo charcoal is disclosed in, for example Patent Document 1, which includes a two-layer structure where an elastic part 103 which provides cushioning properties is laminated in the main part 102.

Patent Document 1: Japanese Patent Application Publication No. 2000-37274,

With the conventional pillow containing bamboo charcoal mentioned above, since the back of the head in contact with a pillow is in a convex form, the thickness of an elastic part is uniform, so that there is a problem that the cushioning properties in the back of the head which sinks in a pillow most are not enough, and a user feels hardness. On the other hand, although the cushioning properties can be increased by enlarging the thickness of an elastic part, if the height of a pillow becomes large, a large force will be applied onto the neck and etc. If the height of a pillow is not changed, because the thickness of a main part becomes small and the effect of bamboo charcoal may decrease, there is a limit in enlarging the thickness of an elastic part. Moreover, although it is better to prepare a crevice between the contact surfaces, without mutually adhering the contact surface of a main part and an elastic part, in order to improve air permeability and to acquire the effect of bamboo charcoal, when the pressure acts from the exterior, and a main part and an elastic part produce a skid etc. mutually, there is also a problem that the internal structure of a pillow changes. Especially, at the time the user changes the sides during sleep, the force more than the weight of the head may act on the pillow, and it is easy to slide mutually on the contact surface of a main part and an elastic part.

The purpose of this invention is to provide a pillow containing bamboo charcoal in which the cushioning properties are raised and the effect of bamboo charcoal can be fully demonstrated.

SUMMARY OF THE INVENTION

The purpose of the present invention is to provide a pillow comprising a main part which has a concave portion formed at a surface, which includes a storage object in which bamboo charcoal is stored, and an elastic part which has a convex part laminated at the above-mentioned main part and is formed in the surface, and shaped to fit with the above-mentioned concave portion of the above-mentioned main part, wherein a portion corresponding to the above-mentioned convex part of the above-mentioned elastic part is thicker than the portion which does not correspond to the above-mentioned convex.

According to this structure, the cushioning properties of the elastic part can be raised by enlarging the thickness in the portion corresponding to the convex part of the elastic part, without enlarging the thickness of all elastic parts. Therefore, a user does not feel hardness but can have a good feeling because the cushioning properties in the back of the head which sinks in the pillow most deeply become enough. Moreover, the portion where the bamboo charcoal is stored is secured by enlarging the thickness of the main part in the portion which does not correspond to the convex part of the elastic part. Furthermore, the concave portion formed in the surface of the main part and the convex part formed in the surface of the elastic part fit together when pressure acts from the exterior, so that the internal structural change of the pillow due to the fact that the main part and the elastic part slide mutually can be prevented without mutually adhering the contact surface of the main part and the elastic part. By establishing a crevice between the contact surfaces of the main part and the elastic part without mutually adhering the contact surfaces of the main part and the elastic part, since air is fully sent into the main part by compression of the elastic part by movement of the head etc., air permeability can become good and the effect of bamboo charcoal can fully be demonstrated.

In the pillow of this invention, the above-mentioned convex part may be formed over the whole long side of the above-mentioned elastic part, and the above-mentioned concave portion may be formed over the whole long side of the main part.

According to this structure, the cushioning properties can be further raised by the convex part of the elastic part formed over the whole long side of an elastic part. When pressure acts from the exterior, since a slide is mutually produced on the contact surface of the main part and the elastic part, it can prevent certainly that the internal structure of the pillow changes.

In the pillow of this invention, the above-mentioned elastic part has two or more elastic materials of mutually different hardness, and the hardness of two or more above-mentioned elastic materials may become large as it comes close to the above-mentioned main part.

The pillow is made soft by increasing the hardness of the elastic material from a side that the user touches the pillow, so that it is possible to provide a soft feeling when the user touches the pillow, and also elastic part can catch the head within the limits of cushioning properties.

In the pillow of this invention, the thickness of two or more above-mentioned elastic materials may become small as it comes close to the above-mentioned main part.

According to this structure, the feeling when a user touches the pillow can be made still softer because the rate of the elastic material with small hardness in the elastic part becomes large.

In the pillow of this invention, the above-mentioned main part is equipped with the core material arranged along the long side, the above-mentioned storage object is arranged at the both sides of the above-mentioned core material, and the above-mentioned concave portion may be arranged in the position corresponding to the above-mentioned core material.

According to this structure, since the core material is arranged in the portion corresponding to the concave portion, the change of the shape at the both sides of the main part bending backward can be presented. Moreover, the cushioning properties of the elastic part can fully be demonstrated because the form of the main part is stable.

In the pillow of this invention, the above-mentioned main part may be arranged at the opposite side to the above-mentioned elastic part corresponding to the cover material which covers the above-mentioned storage object, the above-mentioned core material and the above-mentioned storage object in the inner side of the above-mentioned cover material.

According to this structure, it can prevent the powdered bamboo charcoal from leaking from the storage object cover material to the outside of the pillow by a protection sheet being arranged between the storage object and the cover material.

In the pillow of this invention, the above-mentioned main part may include two or more mutually connected above-mentioned storage objects.

According to this structure, by two or more storage objects being connected, even when the force acts on the pillow from various directions, since storage objects do not overlap mutually, the main part does not change its shape.

DETAILED DESCRIPTION OF PREFERRED EMBODIMENTS

Figure 1:
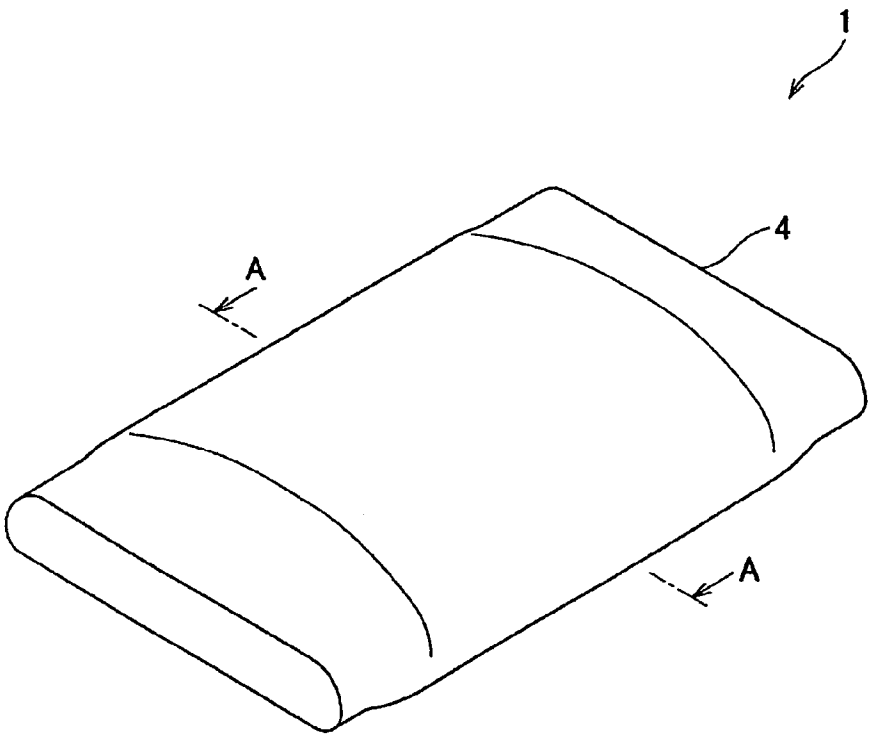
FIG. 1 is an outer perspective view of a pillow according to an embodiment of this invention.
Figure 2:
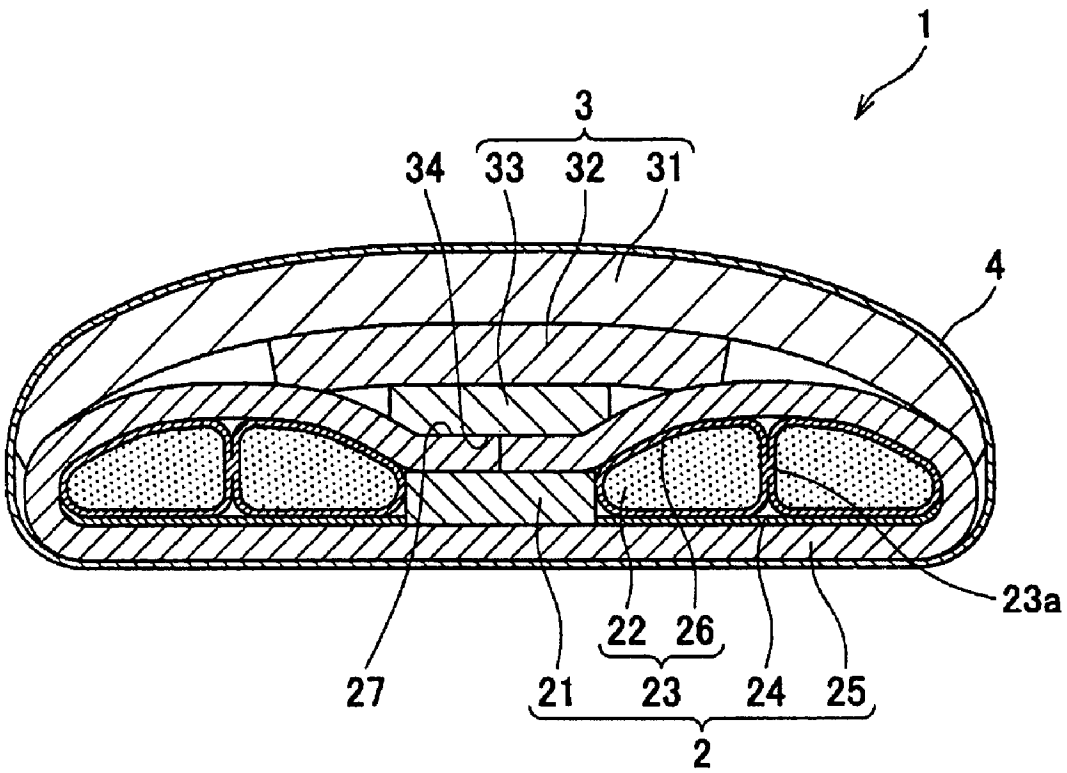
FIG. 2 is a sectional view taken along line A-A of the pillow of FIG. 1.
Figure 3:
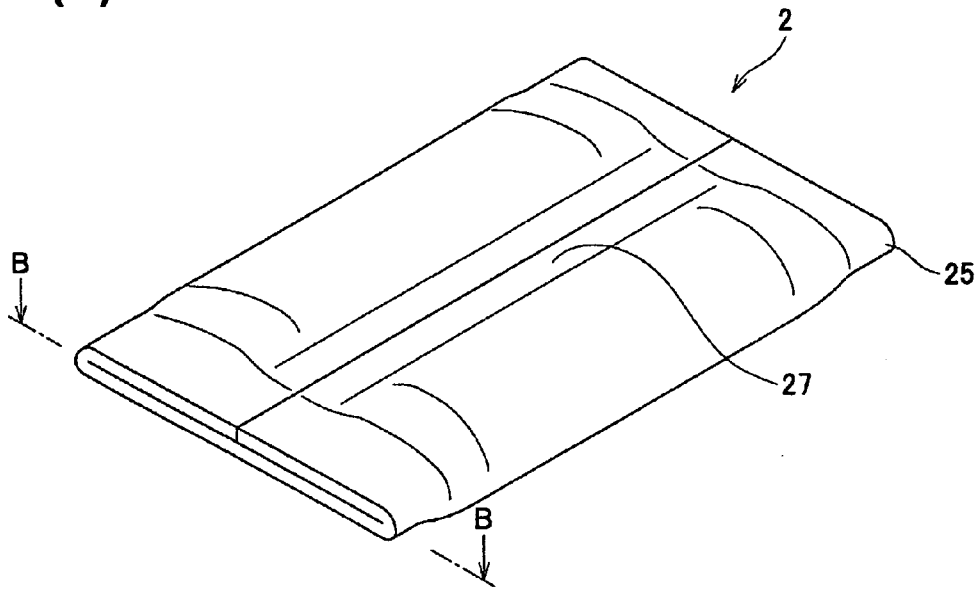
FIGS. 3(*a*) and 3(*b*) are figures explaining a main part, wherein FIG. 3 (*a*) is an outer perspective view and FIG. 3 (*b*) is an upper sectional view taken along line B-B of FIG. 3 (*a*).
Figure 3:
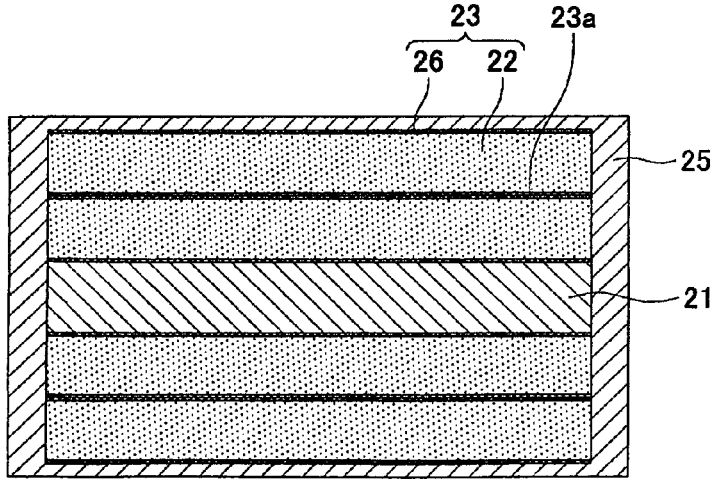
Figure 4:
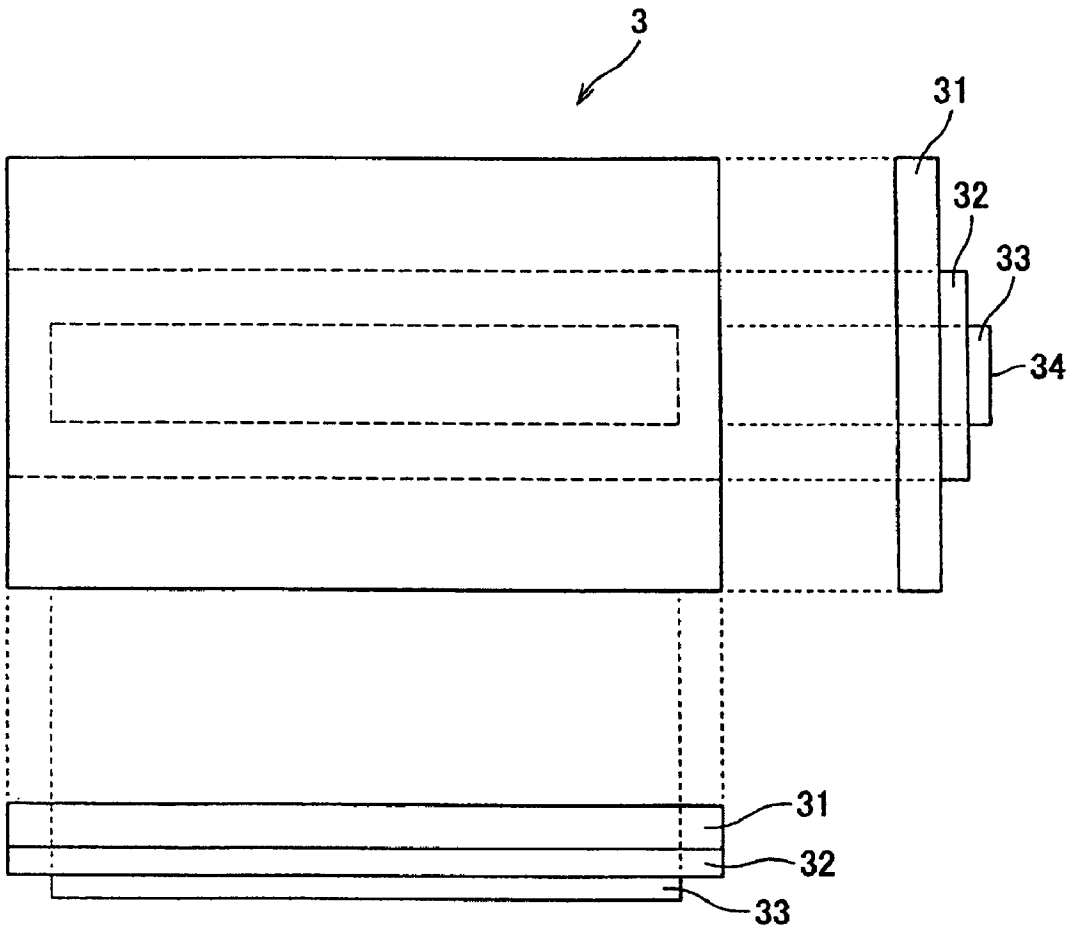
FIGS. 4(*a*) to 4(*c*) are figures explaining an elastic part, wherein FIG. 4 (*a*) is a plan view, FIG. 4 (*b*) is a side view and FIG. 4 (*c*) is a front view.

The preferred embodiments of this invention are explained hereinafter by referring to the drawings. FIG. 1 is an outer perspective view of a pillow according to an embodiment of this invention. FIG. 2 is a sectional view taken along line A-A of the pillow of FIG. 1. FIGS. 3(*a*) and 3(*b*) are figures explaining a main part, wherein FIG. 3 (*a*) is an outer perspective view and FIG. 3 (*b*) is an upper sectional view taken along line B-B of FIG. 3 (*a*). FIGS. 4(*a*) to 4(*c*) are figures explaining an elastic part, wherein FIG. 4 (*a*) is a plan view, FIG. 4 (*b*) is a side view and FIG. 4 (*c*) is a front view The pillow 1 in the embodiment of this invention is in a flat form, as shown in FIG. 1, and its surface is formed with the cover part 4. The pillow 1 has the main part 2 and the elastic part 3 in the cover part 4, as shown in FIG. 2. The elastic part 3 is laminated by the main part 2, and is arranged at a side (upper part in FIG. 2) on which the head is put. And between the contact surfaces of the main part 2 and the elastic part 3 in the pillow, two or more crevices 6 (refer to FIG. 6) are formed.

As shown in FIGS. 2 and 3, the main part 2 is in a flat form, and has a core material 21, storage objects 23 arranged at both sides of the core material 21, and a protection sheet 24 arranged under the storage objects 23 in the cover material 25. And the concave portion 27 is formed in the surface of the main part 2. The concave portion 27 is formed over the whole long side of the main part 2, and is arranged in the position corresponding to the core material 21.

The core material 21 is a component arranged along the long side of the main part 2, and is arranged in the center of the main part 2 in the direction perpendicular to the direction of the long side. The core material 21 has a form lower than the height of the storage objects 23 arranged at both sides. For example, hard urethane etc. is used for the core material 21 as a material with the predetermined hardness. In the embodiment, an elastic material is used for the core material 21, and the core material is formed by the structure where cushioning properties are exhibited in the height direction from the elastic part 3 to the main part 2 in the central part of a pillow 1.

The storage object 23 stores bamboo charcoal 22 in the bag 26 and has a cylindrical flat form. With the form of this embodiment, four storage objects 23 are stored in the main part 2. And all four storage objects 23 are formed such that two storage objects are connected by the connection part 23*a*, and are arranged at both sides along the direction of long side of the main part 2, respectively. In order to make the bag 26 to exhibit the effect of bamboo charcoal, a nonwoven fabric of thermoplastic resin etc. is used as a good material of permeability, for example.

The bamboo charcoal 22 is a powder and has effects, such as deodorant, moisture absorption, and antibacterial properties. And in order to exhibit the effect of bamboo charcoal 22, movement is not added to the charcoal by rubbing the storage object 23, but air is sent into the storage object 23, and it is required for the holes of charcoal 22 to circulate air. In this embodiment, air is sent into the main part 2 by the fact that crevice 6 (referring to FIG. 6) is formed between the contact surfaces of the main part 2 and the elastic part 3 is compressed by the various movements in the four directions of the elastic part 3, so that the effect of bamboo charcoal 22 is fully demonstrated.

The protection sheet 24 is arranged at the opposite side of the elastic part 3 to the storage object 23 in the inner side of the cover material 25. The protection sheet 24 has a rectangle shape. In this embodiment, two protection sheets 24 are stored in the main part 2, and are arranged respectively at both sides of the core material 21 along the direction of long side of the main part 2. And the length of the direction (horizontal direction in FIG. 2) perpendicular to the direction of the long side of the main part 2 of the protection sheet 24 is formed somewhat more greatly than two connected storage objects 23. A nonwoven fabric etc. is used for the protection sheet 24, for example, as a material which passes only air from the outside without passing powdered bamboo charcoal 22.

In order to exhibit the effect of bamboo charcoal 22, half-hard urethane etc. is used for the cover material 25 as a good material of air permeability, for example.

The elastic part 3 has three elastic materials 31, 32, and 33, as shown in FIGS. 2 and 4, and the convex part 34 which fits to concave 27 is formed in the surface. The convex part 34 is formed over the whole direction of the long side of the elastic part 3.

Three elastic materials 31, 32, and 33 are laminated in this order toward the main part 2 and formed by adhering each contact surface. Three elastic materials 31, 32, and 33 have a tabular form, respectively, as shown in the FIGS. 4(*a*) to 4 (*c*). In the direction of the long side of the elastic part 3, the elastic materials 31 and 32 have almost the same length, and the elastic material 33 has the length shorter than the elastic materials 31 and 32. Moreover, the thickness of the elastic parts 31, 32, and 33 become smaller in this order as it approaches the main part 2. And the elastic materials 31, 32, and 33 have different hardness respectively. The hardness of the elastic materials 31, 32, and 33 becomes larger as it approaches the main part 2.

The cover part 4 has the main part 2 and the elastic part 3 in the inside. And the material which has air permeability, for example, a nonwoven fabric etc., is used for the cover part 4.

Figure 5:
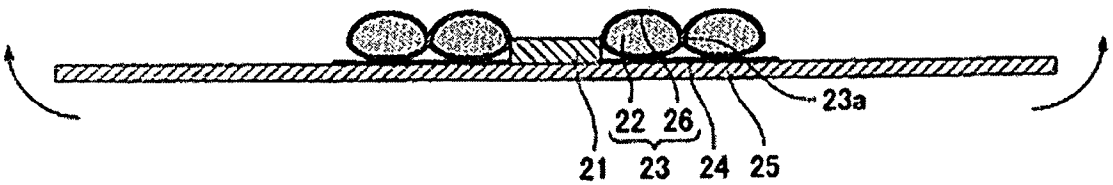
FIG. 5 is a figure explaining the manufacture method of a main part.
Figure 5:
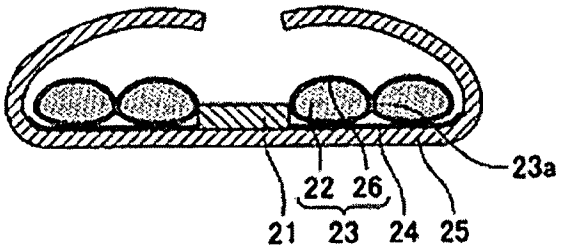
Figure 5:
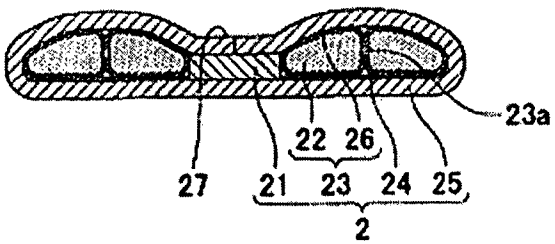

Next, the manufacture method of the main part 2 is explained by referring to FIG. 5. FIG. 5 is a figure explaining the manufacture method of a main part.

First, as shown in FIG. 5 (*a*), the core material 21 is arranged along a direction perpendicular to the direction of the long side of the cover material 25 near the center of the long side of the cover material 25 on the cover material 25 of the shape of a sheet which has a long side shape. At this time, the core material 21 and the cover material 25 are fixed by adhesives etc. Then, each of the two protection sheets 24 is arranged on the cover material 25 at each of both sides of the core material 21. And four storage objects 23 which are formed by connecting two storage objects are arranged on the protection sheet 24, respectively. At this time, the connection part 23*a* of the storage object 23 is arranged in the height direction of the pillow in the central part. In addition, two protection sheets 24 and four storage objects 23 are not being fixed by adhesion material etc.

As shown in FIG. 5 (*b*), the cover material 25 is rolled inside (the direction of the arrow of FIG. 5(*a*)) so that the both ends (right and left in FIG. 5(*a*)) perpendicular to the direction of long side may face each other. Then, as shown in FIG. 5(*c*), the cover material 25 is adhered with the core material 21, after both ends of the direction of the long side has contacted. When the pressure acts from the exterior by the cover material 25 being rolled at this time so that a crevice may hardly be formed in the main part 2, it can prevent the form change of the main part 2 bending backward.

Finally, as shown in FIG. 5(*c*), the main part 2 is completed by adhering the both ends in a direction perpendicular to the direction of the long side of the cover material 25.

Figure 6:
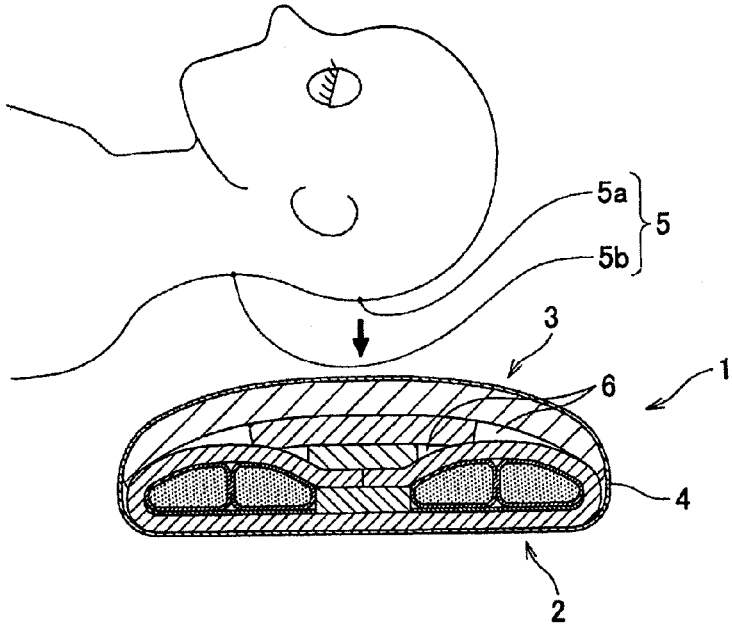
FIGS. 6(*a*) and 6(*b*) are figures explaining an example of use of a pillow, wherein FIG. 6 (*a*) shows a state before the head is put on a pillow and FIG. 6 (*b*) shows a state when the head is put on the pillow.
Figure 6:
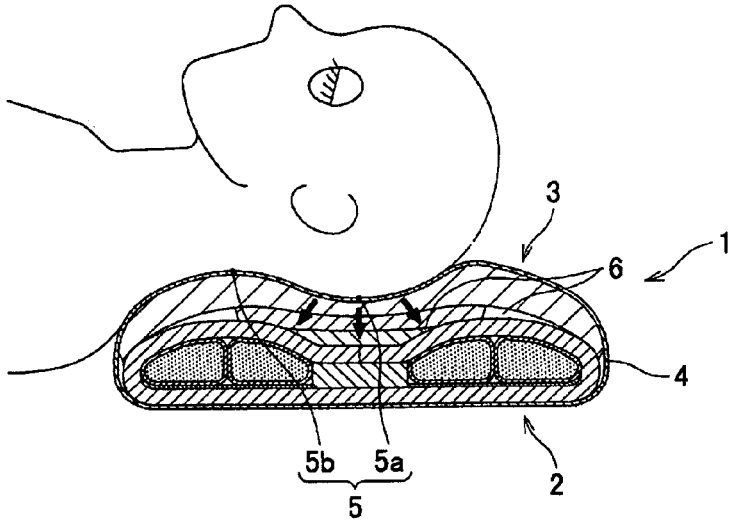
Figure 7:
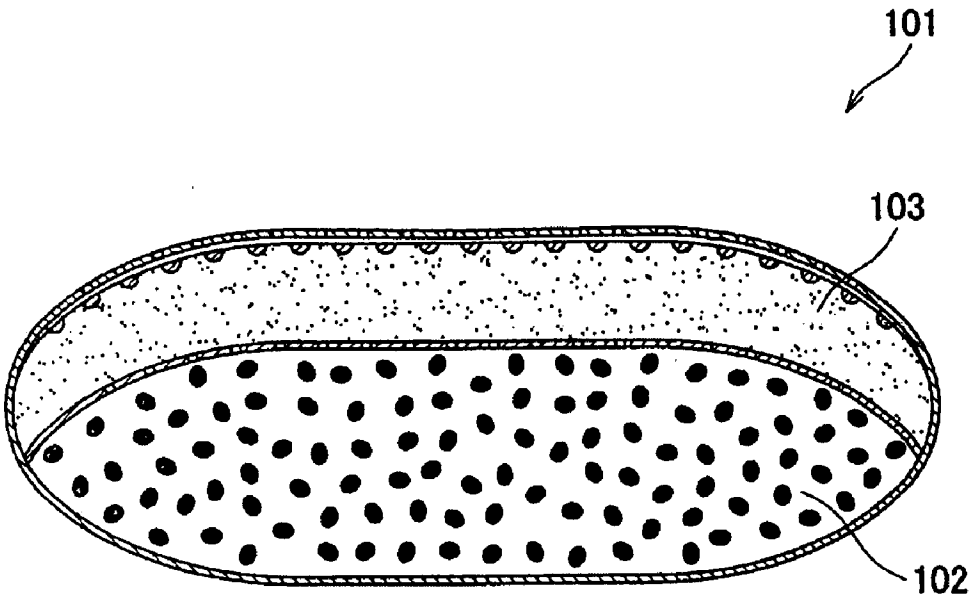
Fig. 7 Prior Art
FIG. 7 is a diagram showing the pillow containing charcoal in the prior art example.

Next, the example of use of the pillow 1 in the embodiment of this invention is explained. FIG. 6 is a figure explaining the example of use of the pillow, wherein FIG. 6(*a*) shows the state before the head is put on the pillow and FIG. 6(*b*) shows the state where the head is put on the pillow.

Generally, the portion in contact with the pillow 1 is the back of the head 5*a* and the head part 5*b*, as shown in FIG. 6(*a*). The back of the head 5*a* is in a convex form, and the surface is hard. The head part 5*b* is in the shape of a concave, and it is soft since the surface is covered with muscles etc. When the head 5 approaches the pillow 1 toward the direction of an arrow, the back of the head 5*a* will contact the pillow 1 first followed by contacting the head part 5*b*.

When the head 5 is put on a pillow 1, as shown in FIG. 6(*b*), the form of the pillow 1 will change into the form which becomes a concave portion near the central part corresponding to the convex form of the back of the head 5*a*. At this time, the elastic materials 31, 32, and 33 and the core material 21 are formed from the elastic material to which hardness becomes large in this order in the height direction over the main part 2 at the concave portion near the central part of the pillow 1 from the elastic part 3. Therefore, the head 5 can be supported within the limits of the cushioning properties of the elastic part 3, without sinking too much deeply in the elastic part 3. Moreover, the head 5 is mainly supported by the back of the head 5*a*, and while the restitution from the pillow 1 to the back of the head 5*a* becomes larger, the restitution from the pillow 1 to the head part 5*b* becomes smaller. Therefore, the burden to the soft head part 5*b* is reduced.

By enlarging the thickness in the portion corresponding to the convex part 34 of the elastic part 3 as explained above, the cushioning properties of the elastic part 3 can be raised without enlarging all the thickness of the elastic part 3. Therefore, a user does not feel hardness but can have a good feeling because the cushioning properties in the back of the head 5*a* which sinks in the pillow 1 most deeply become enough. Moreover, the effect of bamboo charcoal 22 is maintainable by enlarging the thickness of the main part 2 in the portion which does not support the convex part 34 of the elastic part 3. Furthermore, when the pressure acts from the exterior, the concave portion 27 formed in the surface of the main part 2 and the convex part 34 formed in the surface of the elastic part 3 fit to each other without adhering mutually at the contact surface of the main part 2 and the elastic part 3, the internal structure change of the pillow 1 can be prevented as the main part 2 and the elastic part 3 produce a skid etc. mutually. As a crevice between the contact surfaces of the main part 2 and the elastic part 3 is established without adhering mutually the contact surface of the main part 2 and the elastic part 3, and air is fully sent into the main part 2 by compression of the elastic part 3 by movement of the head 5 etc., air permeability can become good and the effect of bamboo charcoal can fully be demonstrated.

In addition, the cushioning properties can be further raised by the convex part 34 of the elastic part 3 formed over the whole direction of the long side of the elastic part 3. Moreover, when the pressure acts from the exterior, the internal structure change of the pillow 1 can be definitely prevented since a skid is mutually produced on the contact surface of the main part 2 and the elastic part 3.

Because the hardness of the elastic materials 31, 32, and 33 is increased in order as the main part 2 is approached from the side which touches a user, a feeling when a user touches the pillow 1 can be made soft, and simultaneously the elastic part 3 can catch the head within the limits of cushioning properties.

Moreover, a feeling when the user touches a pillow 1 can be made still softer because the rate of the elastic material 31 with small hardness in the elastic part 3 becomes large.

Since the core material 21 is arranged at the position corresponding to the concave portion 27 of the main part 2, change of the shape at both sides of the main part 2 bending backward can be prevented when the pressure acts from the outside. Moreover, the cushioning properties of the elastic part 3 can fully be demonstrated because the form of the main part 2 is stable.

Moreover, the leakage of the powdered bamboo charcoal 22 from the storage object 23 through the cover material 25 to the outside of the pillow 1 can be prevented by arranging the protection sheet 24 between the storage object 23 and the cover material 25.

As two or more storage objects 23 are connected, even when the force in the various directions acts on the pillow 1, the storage objects 23 do not overlap mutually, and the form change of the main part 2 can be prevented.

The effect of bamboo charcoal 22 can fully be demonstrated by using a good material of permeability, such as a nonwoven fabric and urethane foam for all the composition articles 21 except bamboo charcoal 22, i.e., core material, the protection sheet 24, the cover material 25, the bag 6, and the elastic material 31, 32, and 33 in the pillow 1 for example.

The fit of the concave portion 27 of the main part 2 and the convex part 34 of the elastic part 3 becomes easy by forming a crevice 6 in the pillow 1.

Although the preferred embodiments of this invention are explained above, it is not restricted to the above-mentioned embodiments and various changes of design are possible for this invention as long as the scope of patent claim is slightly changed. For example, with the form of the above-mentioned working examples, the elastic part 3 is formed by laminating three elastic materials 31, 32, and 33, but the number is not limited. Therefore, the elastic part 3 may have two or four or more elastic materials.

Regarding the form of the above-mentioned embodiment, although the core material 21 has a rectangular parallelepiped form, the form is not limited. Although hard urethane is used for the core material 21, the quality of the material may not be limited. For example, lumber etc. may be used.

Regarding the form of the above-mentioned embodiment, although two storage objects 23 are connected, the number may not be limited, three or more storage objects may be connected.

Regarding the form of the above-mentioned embodiment, although the elastic materials 31, 32, and 33 differ in hardness, the hardness is not limited, another characteristic, for example, density, restitution etc. may differ from each other.

Regarding the form of the above-mentioned embodiment, although the connection part 23*a* of the storage objects 23 is arranged in the height direction of the pillow in the central part, it may not be arranged in the central part. In this case, since the storage objects 23 do not overlap mutually even when the force in the various directions acts on the pillow 1 by two or more storage objects 23 being connected no matter what position the connection part 23*a* of the storage object 23 is arranged, the main part 2 does not change the shape. Therefore, the form of the concave portion 27 of the main part 2 is maintained.

What is claimed is:

1. A pillow comprising:

a main part having at least two storage objects arranged along a longitudinal direction of the main part, a core material formed separately from the at least two storage objects, said core material being arranged between the at least two storage objects and having a thickness smaller than that of at least two storage objects, and a concave portion formed on a surface above the core material, and an elastic part disposed above the main part to extend from one of the at least two storage objects, over the core material, and to other of the at least two storage objects, and having a convex part laminated on the core material, said elastic part engaging the concave portion of the main part, wherein a portion corresponding to the convex part of the elastic part is thicker than a portion which does not correspond to the convex part.

2. A pillow according to claim 1, wherein said convex part is formed over a whole longitudinal direction of the elastic part, and said concave portion is formed over the whole longitudinal direction of the main part.

3. A pillow according to claim 1, wherein said elastic part includes a plurality of elastic materials with different hardness and the hardness of the plurality of elastic materials becomes larger as the elastic materials approach the main part.

4. A pillow according to claim 3, wherein thicknesses of the plurality of elastic materials become smaller as the elastic materials approach main part.

5. A pillow according to claim 1, wherein said core material is arranged along the longitudinal direction and the concave portion is arranged in a position corresponding to the core material.

6. A pillow according to claim 4, wherein said main part has a cover material covering the at least two storage objects, the core material and a protection sheet arranged at an opposite side to the elastic part regarding the storage object in an inner side of the cover material.

7. A pillow according to claim 1, wherein said main part includes a plurality of mutually connected said storage objects.

8. A pillow according to claim 6, wherein the cover material is air permeable.

9. A pillow according to claim 1, wherein each of the at least two storage objects comprises a permeable container and has a bamboo charcoal stored therein.

10. A pillow according to claim 9, wherein the elastic part comprises an upper elastic material, a middle elastic material disposed under the upper elastic material, and a lower elastic material disposed under the middle elastic material, the upper elastic material has a length longer than the lower elastic material in the longitudinal direction, and a width, in a transverse direction of the main part, wider than those of the middle and lower elastic materials, and the middle elastic material has a length same as the upper elastic material, and a width wider than that of the lower elastic material.

11. A pillow according to claim 10, wherein a space is formed laterally outside the middle elastic material between the upper elastic material and the main part.

12. A pillow according to claim 11, wherein the lower elastic material is disposed over the core material.

13. A pillow according to claim 12, wherein the elastic material has a tabular form.

* * * * *